US005944591A

United States Patent [19]

Chen

[11] Patent Number: 5,944,591

[45] Date of Patent: Aug. 31, 1999

[54] SURE-SEAL ROLLING PIN ASSEMBLY

[76] Inventor: Alex Y. Chen, 668 Sierra Place, Gurnee, Ill. 60031

[21] Appl. No.: 09/007,882

[22] Filed: Jan. 15, 1998

[51] Int. Cl.[6] ..... B24B 19/22

[52] U.S. Cl. ..... 451/290; 451/287; 451/291

[58] Field of Search ..... 451/291, 290, 451/287, 288, 285, 269

[56] References Cited

U.S. PATENT DOCUMENTS

| | | |
|---|---|---|
| 2,419,033 | 4/1947 | Primus . |
| 3,731,435 | 5/1973 | Boettcher et al. . |
| 4,256,351 | 3/1981 | Langford, Jr. . |
| 4,315,383 | 2/1982 | Day . |
| 4,730,883 | 3/1988 | Foster et al. . |
| 4,974,370 | 12/1990 | Gosis . |

FOREIGN PATENT DOCUMENTS

| | | | |
|---|---|---|---|
| 1252356 | 10/1989 | Japan | 451/288 |

*Primary Examiner*—Robert A. Rose
*Attorney, Agent, or Firm*—Charles F. Meroni, Jr.

[57] ABSTRACT

A sure-seal rolling pin assembly of a lapping and polishing machine for substantially eliminating friction between the sure-seal rolling pin assembly and a work carrier and for substantially reducing particle contamination between the sure-seal rolling pin assembly and the work carrier. The lapping and polishing machine has a plurality of gears operatively connected to one another by the work carrier and each gear has a counterbore which has a surface. The sure-seal rolling pin comprises a pin, a plurality of ball bearing units and a torsionally stretchable seal. The pin has a longitudinal axis, a head portion and a body portion connected to the head portion and the head portion has a diameter and an outer surface. The body portion has a lower surface located adjacent the outer surface and is removably inserted into the counterbore of one of the gears. The plurality of ball bearing units are axially retained and concentrically connected to the body portion and are also connected to the surface of the counterbore so as to allow the pin to rotate about the longitudinal axis. The torsionally stretchable seal has a relaxed state and is capable of elastic restorability. The torsionally stretchable seal creates a seal between the pin and the surface of the counterbore while in the relaxed state. The torsionally stretchable seal has an upper face, an inner diameter, and an outer diameter concentrically located around the inner diameter and the inner diameter is connected to the lower surface of the body portion so as to allow the inner diameter to torsionally stretch when dragged by the rotation of the pin about the longitudinal axis. The inner diameter maintains fall contact with the lower surface of the body portion while the pin undergoes rotational movement about the longitudinal axis. The outer diameter is connected to the surface of the counterbore and maintains full stationary contact with the surface of the counterbore while the pin undergoes rotational movement about the longitudinal axis. The torsionally stretchable seal maintains a seal between the pin and the surface of the counterbore while the pin undergoes rotational movement about the longitudinal axis and maintains the seal while the pin returns to the relaxed state.

8 Claims, 6 Drawing Sheets

SURE-SEAL ROLLING PIN ASSEMBLY

BACKGROUND OF THE INVENTION

1. Field of the Invention

The present invention relates to rolling pins for abrading machines. More specifically, the sure-seal rolling pin assembly is primarily intended for use with lapping, polishing, and grinding machines to protect the ball bearings from abrasive contamination during lapping and polishing operations and to maximize the size of the pins used in such operations.

2. Description of the Prior Art

In the art of abrading machines, double-sided planetary lapping and polishing machines use involute gearing mechanisms to drive work carriers nested between a sun gear and a ring gear. Work pieces that are being processed on the machines are dragged by the work carriers in a serpentine path between an upper lap plate and a lower lap plate charged with abrasives. Although involute gearing provides near perfect meshing in an ideal environment, it has its problems in planetary lapping and polishing machines.

Gear teeth on both the sun gear and the ring gear wear out quickly and unevenly due to the continuous meshing between the work carriers and the sun gear and ring gear. The presence of the abrasives used during lapping and polishing operation deteriorates the excess wear. Besides, involute gears, especially ring gears with internal teeth, are very expensive to manufacture. If a tooth is worn out, the whole gear must be replaced. For this reason, pin gears have become popular.

A pin gear has a gear body and a plurality of vertically projecting pins mounted on the gear body. Each pin functions as a gear tooth and meshes and drives sprocket-type work carriers. Many prior double-sided lapping and polishing machines utilized this type of pin gear drive to provide motion to the work carriers. This conventional pin drive has an advantage over involute gears in that pins can be separately replaced when worn out. U.S. Pat. Nos. 4,315,383 and 4,974,370 are examples of double-sided lapping and polishing machines using pin drives.

Conventionally, there are three types of pins used in pin gears, i.e. fixed pins, sliding pins, and rolling pins. Fixed pins have been widely used due to their low cost to manufacture. However, fixed pins have a decided disadvantage that the pins and their mating components or work carriers, are worn out very quickly due to their severe sliding actions. The friction of this severe sliding action not only deteriorates the pins themselves, but also wears the teeth of the work carriers and generates particle contamination harmful to lapping, polishing and grinding processes. The particles scratch surfaces of work pieces and deteriorate their finish.

To reduce the wear between the pins and the work carriers, sliding pins have also been used on some planetary lapping and polishing machines. The sliding pins employ a bushing type of sleeves similar to those in roller chains. Theoretically, if sleeves and pins are properly lubricated, then the sliding occurs between the sleeves and the pins instead of between the sleeves and the teeth of work carriers, hence the wear on the teeth of the work carriers and the sleeves can be minimized. However, in abrading machines of the type employing pin drives, the friction between the sleeves and the pins are often higher than the friction between the sleeves and the work carriers due to the poor lubrication caused by the presence of abrasive during normal operation.

Rolling pins are therefore used to overcome the problems associated with fixed and sliding pins. The rolling pins use miniature ball bearings between sleeves, or rings, and the pins themselves. The ball bearing provides a rolling element which virtually eliminates the friction between the sleeve or ring and the pin, and therefore, the ball bearing eliminates sliding action between the sleeves or rings and the work carriers. Rolling pin gears can therefore, significantly prolong the life expectancy of not only the pins themselves but also the work carriers. An additional benefit is the reduction of particle contamination when a rolling pin is used compared to other planetary gear drives.

U.S. Pat. No. 4,974,370 is an example of a double-sided lapping and polishing machine having drive pins 26 and 28. Drive pins 26 and 28 consist of a headed bolt 29, the reduced shank portion 30 of which is adapted to be threaded into a tapped aperture formed in an inner gear 25 and an outer gear ring 27 respectively. A ball bearing supported drive ring 31 is journalled on the bolt 29 between the bolt's enlarged head and a retaining washer 32. This construction, however, does not provide a sealing feature to prevent the bearings from abrasive contamination during normal lapping and polishing operation. Conventional seals, like O-rings, do not work in rolling pins because slurries of fine abrasives and the like will penetrate into the clearances between the seals and the pins, and will eventually bond the seals and pins together.

Furthermore, small pitch in the pin gears of a lapping and polishing machine is desired in order to have smooth gearing between the ring and sun gears and the work carriers and therefore to minimize the speed fluctuation of the work carriers. Small pitch of pin gears is the distance between adjacent pins as measured from substantially similar points on each pin. In order to achieve a small pitch of pin gears in the '370 drive pins 26 and 28, the diameter of the headed bolts must be small enough so that miniature ball bearings, can fit around the outer surface of each bolt and fit within the space between adjacent pins. However, this smaller diameter reduces the rigidity of each pin and its ability to drive the work carriers due to meshing forces on the pins. In addition, the apertures, where the '370 drive pins 26 and 28 are placed on the inner gear 25 and the outer gear ring 27 respectively, must be tapped and therefore are expensive to manufacture.

Lastly, in order that the work carriers mesh, or ride and rotate, properly about the drive pins and due to wear of the upper and lower plates of the lapping and polishing machine, the elevation of the work carriers, meaning the vertical adjustment, must be adjusted from time-to-time. The pin drive of the '370 machine requires precise control of its elevation because the carrier 23 meshes with the drive ring 31 supported by the ball bearing and not with the outer surface of the bolt itself.

U.S. Pat. No. 4,315,383 also shows the inner gear drive for an abrading machine. In particular, the '383 machine employs protective sleeves 47 and 48 which fit upon drive pins 44 and gear pins 21. The protective sleeves 47 and 48 are of a length greater than their corresponding pins and as such project above the top of the corresponding pins. The protective sleeves 47 and 48 also project into the enlarged counterbores 46 surrounding the openings which contain the gear pins so that the sleeves lie beneath the plane surface of the gear 32 and lap 16. This arrangement of protective sleeves, however, is not secured to the pins and as such may slip off during lapping and polishing. In addition, the use of enlarged counterbores without sealing rings allows for the potential intrusion of abrasives and deleterious substances within the openings 45 and the enlarged counterbores 46 which could eventually wear down the pins and cause the protective sleeves to loosen and slip off the pins.

It is therefore an object of my invention to take advantage of the fact that pins in a pin gear only rotate at a very small angle. By using a torsionally stretchable seal, the pin drags and stretches the seal during its slight rotation, yet always maintains a full contact with the seal. The seal guaranties a life time protection to the bearings from abrasive contamination during lapping and polishing operation.

It is a further object of my invention to also incorporate inner rings of miniature ball bearings into the pins so that the pin size can be maximized to provide maximum bolt rigidity.

It is a further object of my invention to provide a greater area of contact between the work carrier and the pin in order to minimize the elevational adjustment required.

It is another object of my invention to decrease the wear on the pins of lapping and polishing machines and to reduce the manufacturing costs of the process thereby, as well as to minimize the downtime of the machine.

A further object is to provide a second embodiment of my invention whereby a protective cap having a securing mechanism and optimal length is placed over each pin and rests upon the torsionally stretchable seal in order to increase the life of the pin, decrease its wear, and prevent the intrusion of slurries of abrasive materials from wearing down the pin and bonding the pin and seal. The protective cap can be readily replaced to minimize the downtime of the lapping and polishing machine. As will be described in greater detail hereinafter, the apparatus relating to the present invention differs from those previously proposed.

Other objects of my invention, as well as particular features, elements, and advantages thereof, will be elucidated in, or apparent from, the following description and the accompanying drawing figures.

SUMMARY OF THE INVENTION

According to the features of my invention, I have provided a sure-seal rolling pin assembly for a lapping and polishing machine for substantially eliminating friction between the sure-seal rolling pin assembly and a work carrier and for substantially reducing particle contamination between the sure-seal rolling pin assembly and the work carrier, the lapping and polishing machine having a plurality of gears operatively connected to one another by the work carrier, each gear having a counterbore, the counterbore having a surface, the sure-seal rolling pin assembly comprising: a pin having a longitudinal axis, a head portion and a body portion being connected to the head portion, the head portion having a diameter and an outer surface, the body portion having a lower surface being located adjacent the outer surface, the body portion being removably inserted into the counterbore of one of the gears; a plurality of ball bearing units being axially retained and concentrically connected to the body portion, the plurality of ball bearing units being connected to the surface of the counterbore and allowing the pin to rotate about the longitudinal axis; and a torsionally stretchable seal having a relaxed state and capable of elastic restorability, the torsionally stretchable seal creating a seal between the pin and the surface of the counterbore while in the relaxed state, the torsionally stretchable seal having an upper face, an inner diameter, and an outer diameter being concentrically located around the inner diameter, the inner diameter being connected to the lower surface of the body portion so as to allow the inner diameter to torsionally stretch when dragged by the rotation of the pin about the longitudinal axis, the inner diameter maintaining full contact with the lower surface of the body portion while the pin undergoes rotational movement about the longitudinal axis, the outer diameter being connected to the surface of the counterbore, the outer diameter maintaining fall stationary contact with the surface of the counterbore while the pin undergoes rotational movement about the longitudinal axis, the torsionally stretchable seal maintaining a seal between the pin and the surface of the counterbore while the pin undergoes rotational movement about the longitudinal axis, the torsionally stretchable seal maintaining the seal while the pin returns to the relaxed state.

Another feature of my invention relates to a protective cap being removably connected to a top surface of the head portion of the pin by the insertion of connecting means through the protective cap and into a counterbore of the head portion, the protective cap protecting the pin, the protective cap concentrically enclosing the head portion and operatively connected to the upper face of the torsionally stretchable seal to allow the torsionally stretchable seal to torsionally stretch when dragged by the rotation of the pin.

A further feature of my invention is a sure-seal rolling pin assembly for substantially reducing particle contamination when operated with a lapping and polishing machine for substantially eliminating friction between the sure-seal rolling pin assembly when operated with a gear driven work carrier with a counterbore gear surface. The improvement comprises a pin having a longitudinal axis, the pin being for cooperative engagement with the counterbore gear surface; a plurality of ball bearing units being axially retained and concentrically connected to the pin, the plurality of ball bearing units for connection to the counterbore gear surface to allow the pin to rotate about said longitudinal axis; and a torsionally stretchable elastomeric seal having a memory characteristic with the seal being movable back and forth relative to an outside surface of the pin from a relaxed sealed state to a stretched sealed state to avoid particle contamination.

DESCRIPTION OF THE DRAWINGS

Other features of my invention will become more evident from a consideration of the following detailed description of my patent drawings, as follows.

DETAILED DESCRIPTION OF THE PREFERRED EMBODIMENT

Figure 1:
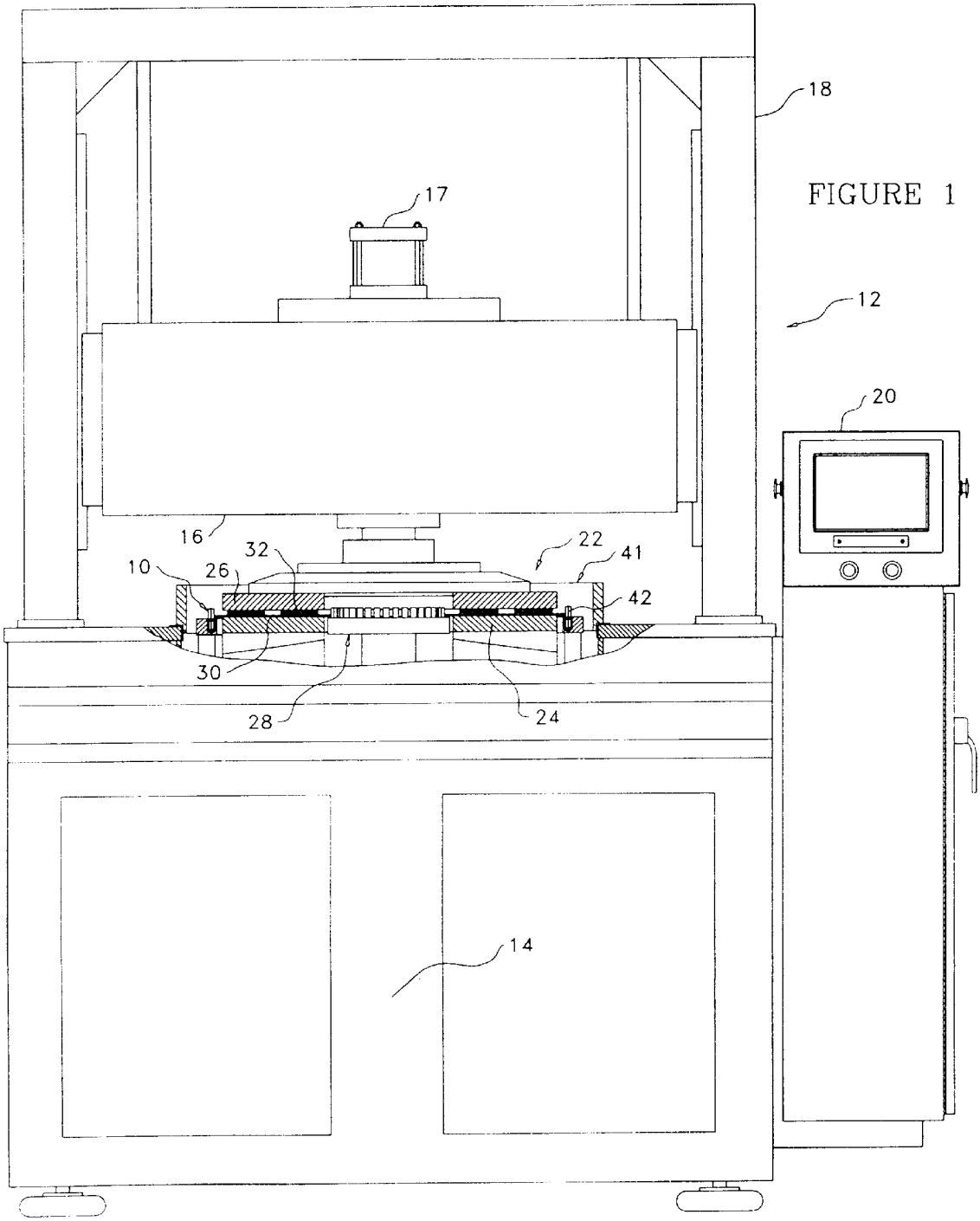
FIG. 1 is a side elevational section view of a double-sided lapping and polishing machine that employs my invention, sure-seal rolling pin assembly.
Figure 4:
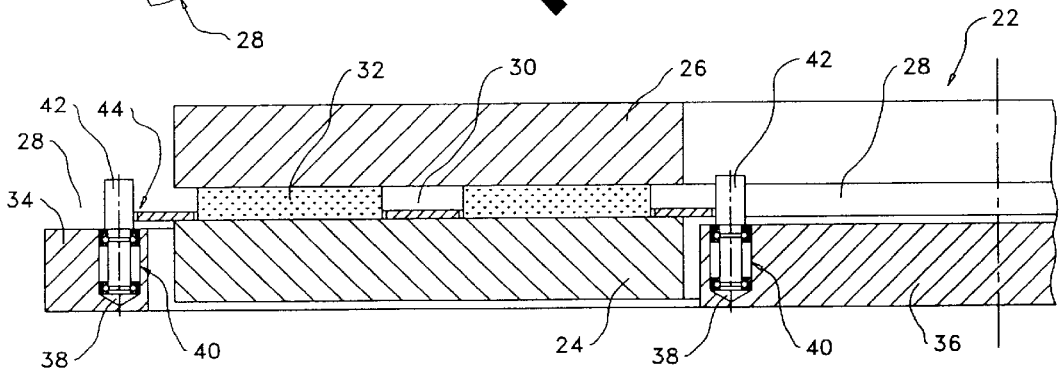
FIG. 4 is a side elevational section view of the placement of the sure-seal rolling pin assembly in the plurality of gears as shown in FIG. 3 now showing the meshing of the sure-seal rolling pin assembly with the work carriers and the placement of the work pieces in the work carriers.

Referring now to the drawings, FIG. 1 shows a planetary type double-sided lapping and polishing machine 12 with my present invention, the sure-seal rolling pin assembly 10, incorporated therein. The machine 12 includes a base 14, an upper beam 16, a bridge 18, and electrical control systems 20 in addition to its planetary pin gear drive mechanism 22. The planetary pin gear drive mechanism 22 comprises a lower lap plate 24, an upper lap plate 26, a plurality of gears 28, at least one work carrier 30, also known as a gear driven work carrier in other embodiments, and work pieces 32 as shown in FIGS. 1 and 4. In addition, the plurality of gears 28 are operatively connected to one another by the work carrier 30.

Figure 2:
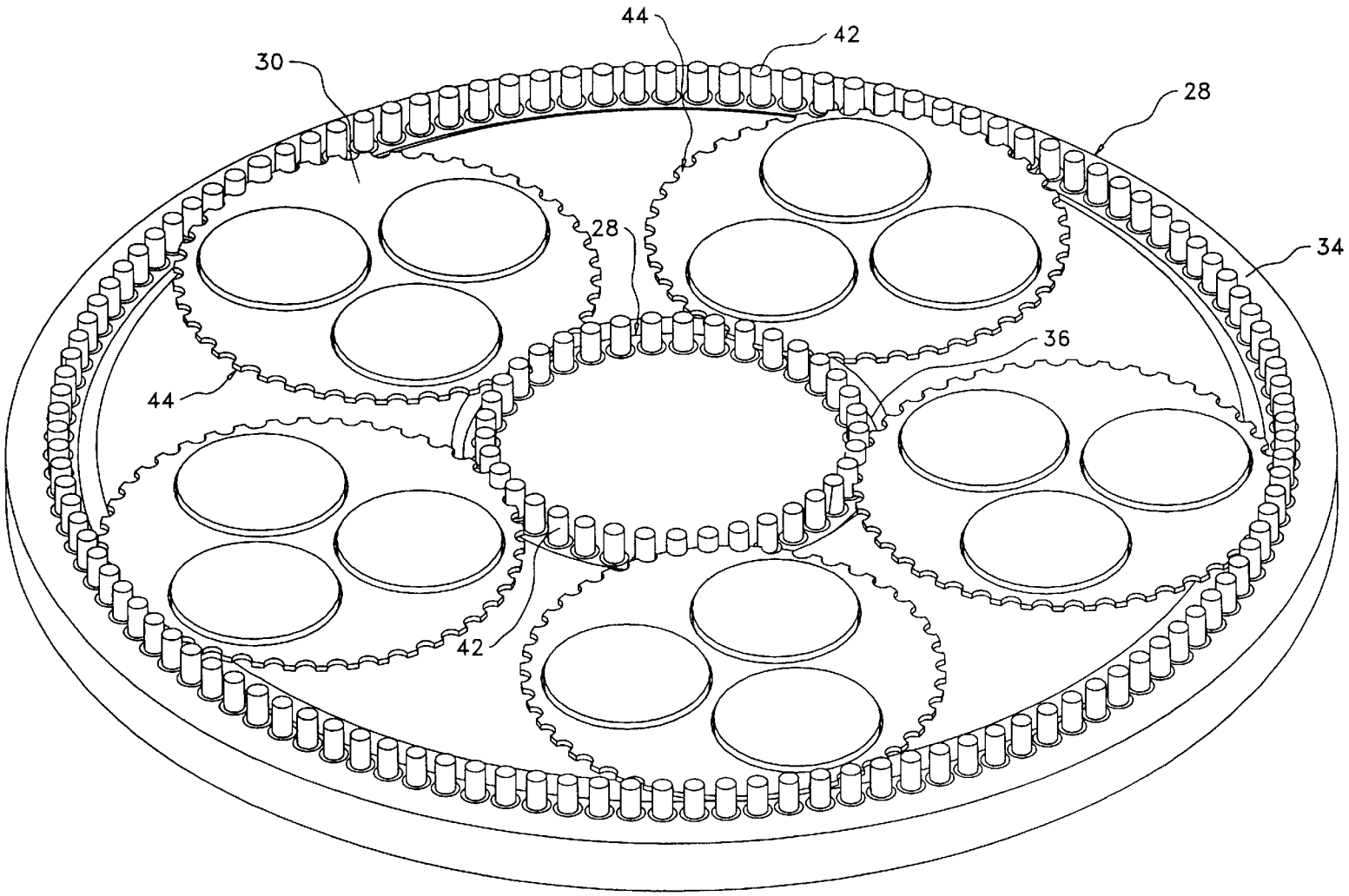
FIG. 2 is a top perspective view of the plurality of gears and the work carriers of the lapping and polishing machine of FIG. 1 showing the placement of the sure-seal rolling pin assembly.
Figure 3:
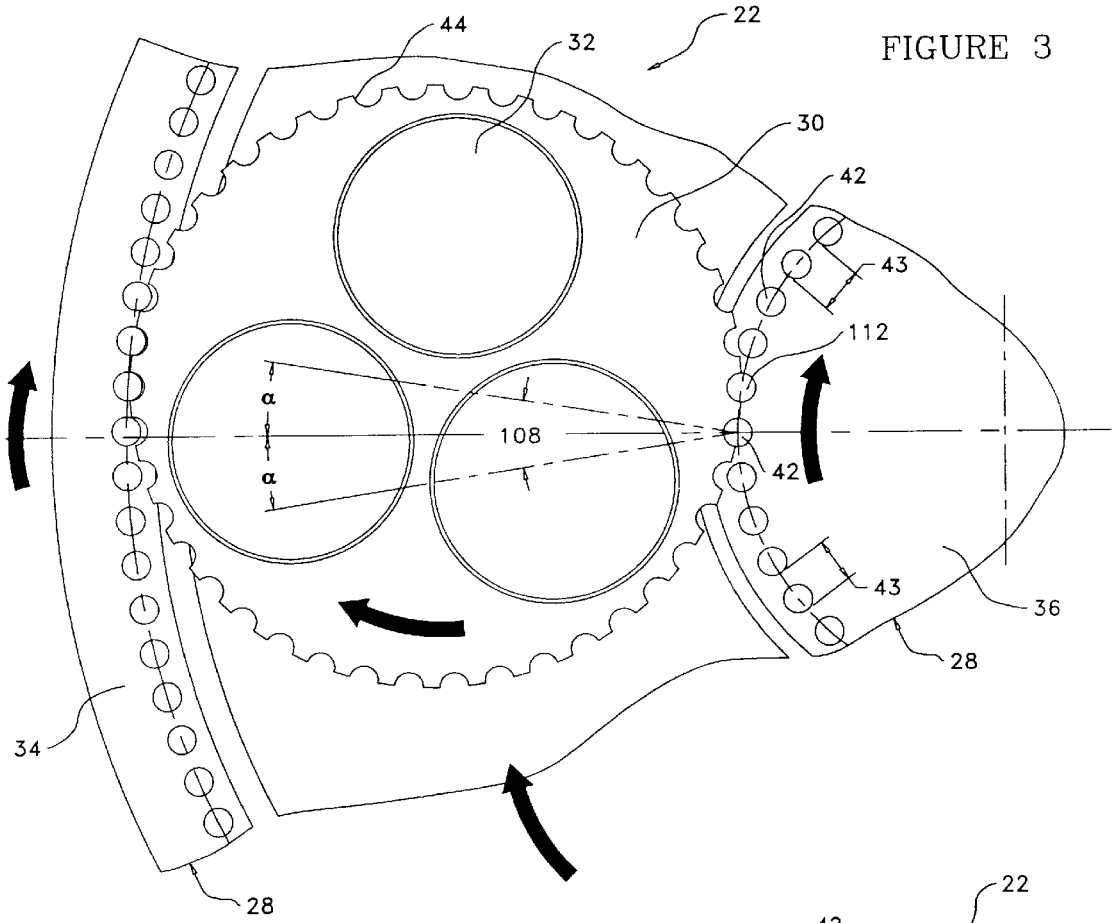
FIG. 3 is a fragmentary top plan view of the plurality of gears and the work carriers shown in FIG. 2, now showing the rotation of the sure-seal rolling pin assembly with the revolution of the work carriers.
Figure 6:
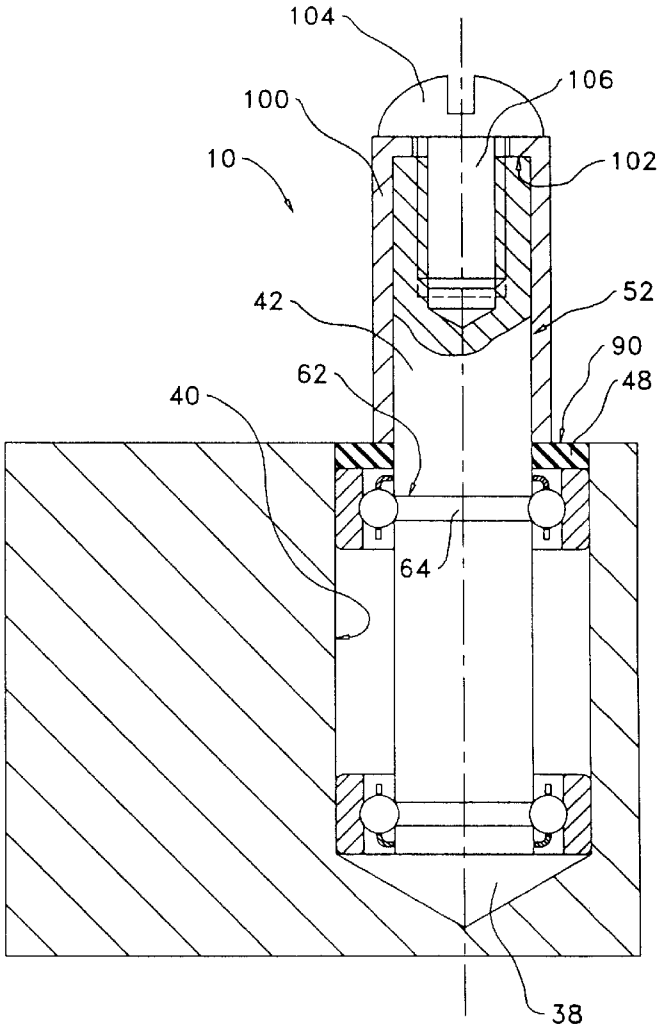
FIG. 6 is a side elevational section view of a second embodiment of the sure-seal rolling pin assembly showing the pin, the plurality of ball bearing units, the torsionally stretchable seal, and the protective cap.
Figure 5:
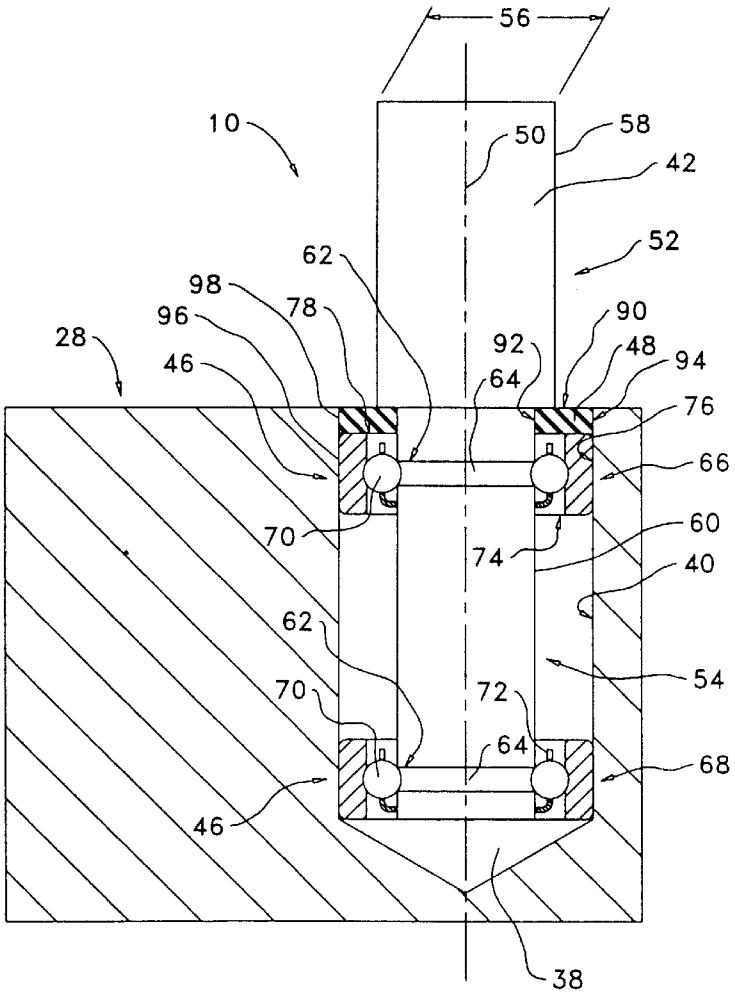
FIG. 5 is a side elevational section view of the first embodiment of the sure-seal rolling pin assembly showing the pin, the plurality of ball bearing units, and the torsionally stretchable seal.

The plurality of gears 28, as shown in FIGS. 2 and 3, comprises a ring gear 34 and a sun gear 36. Each gear 28 has a counterbore 38 which has a surface 40 on the inside of the counterbore 38 as shown in FIGS. 4–6. In other embodiments the work carrier 30 has a counterbore gear surface. The counterbore 38 is pre-drilled on either the ring gear 34 or the sun gear 36. Surrounding the planetary pin drive mechanism 22, as shown in FIG. 1, is a splash guard 41 protecting spilling of fluid abrasive. In action, for example, the lower lap plate 24 rotates clockwise (not shown) while the upper lap plate 26 rotates counter clockwise (not shown) at a different speed than the lower lap plate 24. Both the ring gear 34 and the sun gear 36 have pins 42 that vertically project as shown in FIGS. 2 and 4, such as the sure-seal rolling pin assembly 10, and the pins 42 are equally spaced and mounted near their peripheries. The ring gear 34 and the sun gear 36 rotate at different speeds in either direction. The pins 42 on both the ring gear 34 and the sun gear 36 independently propel work carriers 30 having toothed peripheral edges or teeth 44 like the sprockets in a chain transmission.

The arrows in FIG. 3 show typical directions of the ring gear 34 and the sun gear 36 and the work carriers 30, though each gear or carrier can rotate in the opposite direction. These rotations generate a planetary motion necessary to spur work pieces 32 in a serpentine path through the work carriers 30 between the upper lap plates 26 and the lower lap plates 24. With abrasive fed on to the lap plates in a form of slurry through an abrasive pump (not shown), and with proper pressure applied on the work pieces 32 from a down pressure control cylinder 17, the work pieces 32 are lapped and polished.

A detailed assembly of the first embodiment of my invention, the sure-seal rolling pin assembly 10, is shown in FIG. 5. The sure-seal rolling pin assembly 10 comprises a pin 42, a plurality of ball bearing units 46, and a torsionally stretchable seal 48. The pin 42 has a longitudinal axis 50, a head portion 52, and a body portion 54 that is connected to the head portion 52. The head portion 52 has a diameter 56 and an outer surface 58 and the body portion 54 has a lower surface 60 that is located adjacent the outer surface 58. The body portion 54 is removably inserted into the counterbore 38 of one of the gears 28, meaning either the ring gear 34 or the sun gear 36. The pin 42 can be made of 400 series stainless steels which can achieve high surface hardness after heat treatment. These stainless steels, especially 440C, show relative good corrosion resistance to many acids and bases.

The lower surface 60 further comprises, as shown in FIGS. 5 and 6, a plurality of inner rings 62 each having a groove 64 for connecting each ball bearing unit 46 to the body portion 54. In this way the plurality of inner rings 62 maximizes the diameter 56 of the head portion 52 of the pin 42 because the plurality of ball bearing units 46 take less space in the counterbore 38 and a bigger, stronger pin 42 can be used to resist the wear and tear of the lapping and polishing process. Since the desired pitch 43, as shown in FIG. 3, of the lapping and polishing machine 12 is a small pitch, then this utilization of greater diametered pins 42 maximizes the rigidity of the pin 42 and increases the life of the pin 42 and reduces the maintenance of the pin structures on the lapping and polishing machine 12. The lower body portion 54 can also have a lower body portion diameter which is maximized by use of the plurality of inner rings 62.

In addition, the plurality of ball bearing units 46, as shown in FIGS. 5 and 6, are each axially retained and concentrically connected to the body portion 54 and are also connected to the surface 40 of the counterbore 38 so as to allow the pin 42 to rotate about the longitudinal axis 50. The plurality of ball bearing units 46 further comprise an upper ball bearing unit 66 and a lower ball bearing unit 68 that is axially located opposite the upper ball bearing unit 66. The upper ball bearing unit 66 and the lower ball bearing unit 68 are both concentrically located about the longitudinal axis 50 and each ball bearing unit 46 further comprises a plurality of balls 70, a crown-shaped retainer 72 operatively connected to the plurality of balls 70, and an outer ring 74 substantially enclosing the plurality of balls 70 and the crown-shaped retainer 72. The crown-shaped retainer 72 keeps the plurality of balls 70 evenly spaced around each inner ring 62.

The outer ring 74 has an outer surface 76 and a top surface 78 that is located normal and adjacent to the outer surface 40 of the counterbore 38. The plurality of balls 70 ride in one of the inner rings 62 in a substantially frictionless manner and the outer surface 76 of the outer ring 74 is connected to the surface 40 of the counterbore 38. Furthermore, with the plurality of inner rings 62 incorporated into the pin 42 itself, axial retention of the ball bearing units 46 is not necessary as compared to installations of commercial ball bearings onto a shaft.

The torsionally stretchable seal 48, as shown in FIGS. 5–10, performs the crucial functions of substantially eliminating friction and substantially reducing particle contamination between the sure-seal rolling pin assembly 10 and the work carrier 30. In other embodiments the torsionally stretchable seal 48 is a torsionally stretchable elastomeric seal. The torsionally stretchable seal 48 prevents the abrasives used in the lapping and polishing process from entering into each ball bearing unit 46 and from contaminating them and causing the pin 42 and the ball bearing unit 46 to bond together and thereby resist rotational movement. The torsionally stretchable seal 48 has a snug fit on the pin 42 and exhibits a water tight seal without additionally applying sealant or adhesive.

Figures 7, 8:
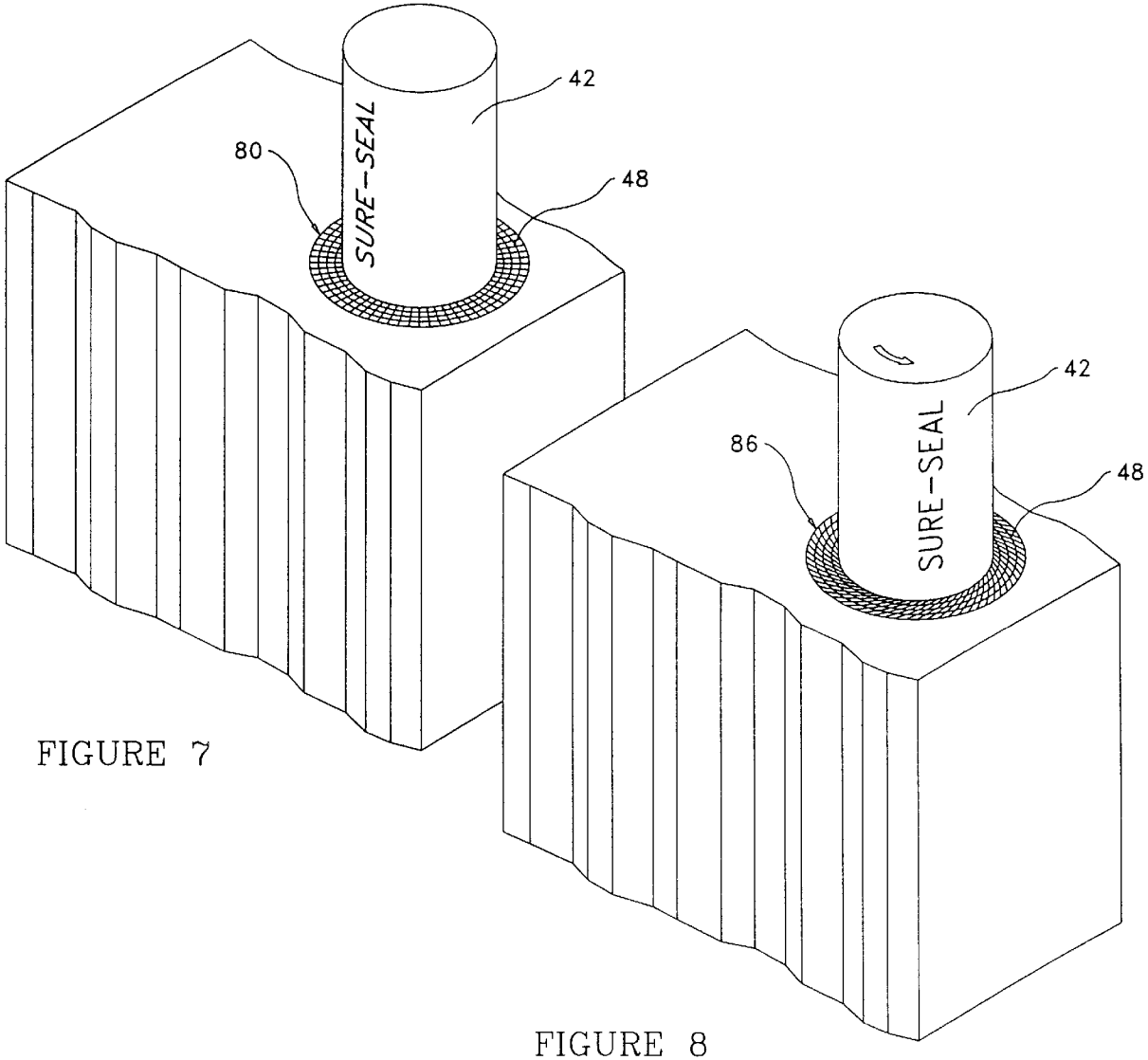
FIG. 7 is a top perspective view of the sure-seal rolling pin assembly in a relaxed state.
FIG. 8 is a top perspective view of the sure-seal rolling pin assembly in a working state, now showing the pin rotating and the torsionally stretchable seal torsionally stretching with the rotation of the pin.
Figure 9:
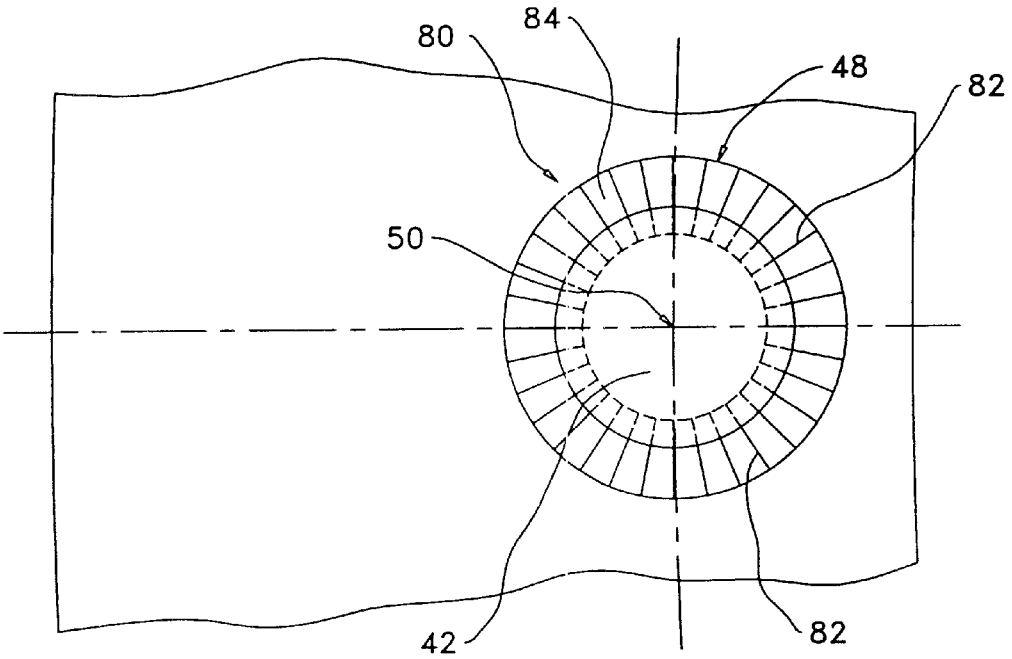
FIG. 9 is a top view of the sure-seal rolling pins shown in FIG. 7, now showing the pin a relaxed state and a diagrammatical depiction of the torsionally stretchable seal in the relaxed state.
Figure 10:
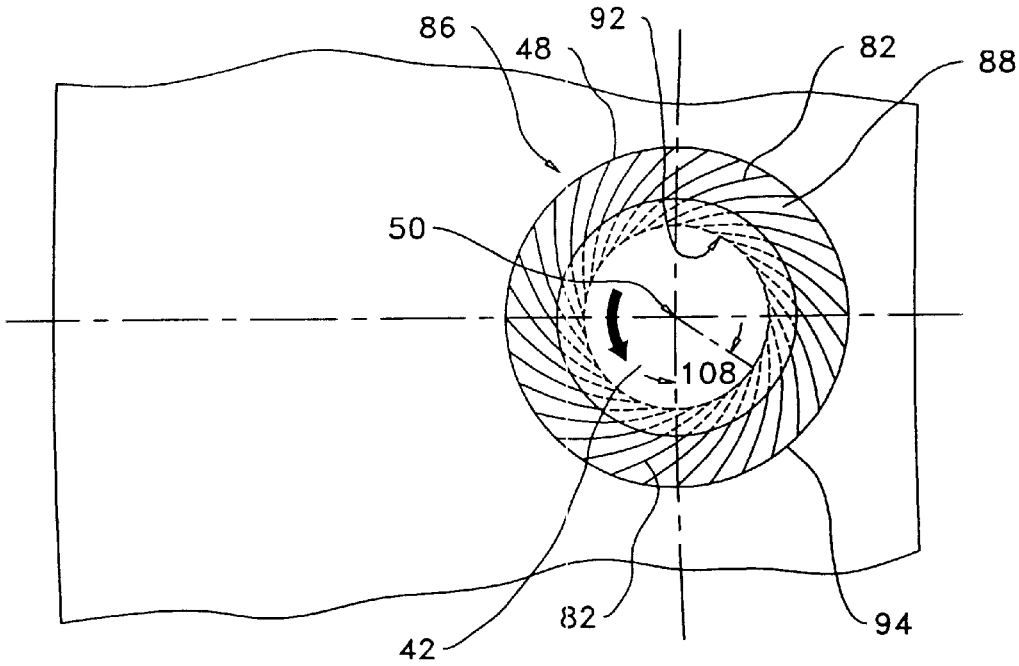
FIG. 10 is top view of the sure-seal rolling pins shown in FIG. 8, now showing the pin in a working state and a diagrammatical depiction of the torsionally stretchable seal torsionally stretching with the rotation of the pin.

The torsionally stretchable seal 48 has a relaxed state 80, as is diagrammatically shown in FIGS. 7 and 9 by means of lines 82 which form square/trapezoidal shapes 84 and by looking axially at the pin 42, and the torsionally stretchable seal 48 is capable of elastic restorability back to the relaxed state 80 after it has been torsionally stretched 86, as is diagrammatically shown in FIGS. 8 and 10 by means of the lines 82 which now form parallelogram shapes 88 and by looking axially at the pin 42. The torsionally stretchable seal 48 creates a seal between the pin 42 and the surface 40 of the counterbore 38 while in the relaxed state 80. As seen in FIGS. 5 and 6, the torsionally stretchable seal 48 has an upper face 90, an inner diameter 92, and an outer diameter 94 that is concentrically located around the inner diameter 92 and the inner diameter 92 is connected to the lower surface 60 of the body portion 54 so as to allow the inner diameter 92 to torsionally stretch when dragged by the rotation of the pin 42 about the longitudinal axis 50. The inner diameter 92 maintains full contact with the lower surface 60 of the body portion 54 while the pin 42 undergoes rotational movement about the longitudinal axis 50. The outer diameter 94 is connected to the surface 40 of the counterbore 38 and maintains full stationary contact with the surface 38 of the counterbore 40 while the pin 42 undergoes rotational movement about the longitudinal axis 50. The torsionally stretchable seal 48 therefore maintains a seal between the pin 42 and the surface 40 of the counterbore 38 while the pin 42 undergoes rotational movement about the longitudinal axis 50 and maintains the seal while the pin 42 returns to the relaxed state 80. In other embodiments this ability to stretch from a relaxed state 80 to a state of being torsionally stretched 86 is described as a memory characteristic. Furthermore, in other embodiments the relaxed state 80 is a relaxed sealed state and the state of being torsionally stretched 86 is a stretched sealed state.

Now, the connections are shown in FIGS. 5 and 6. The outer surface 76 of the outer ring 74 of the upper ball bearing unit 66 is adhesively connected to the surface 40 of the counterbore 38 by use of a small amount of retaining compound 96, such as Anaerobics, expoxies, silicones, contact cements, construction adhesives, and the like. The retaining compound 96 is only applied to the outer ring 74 of the upper ball bearing unit 66 so that the sure-seal rolling pin assembly 10 can be readily disassembled in case that a replacement is needed. The outer surface 76 of the outer ring 74 of the lower ball bearing unit 68 is frictionally connected to the surface 40 of the counterbore 38, however it is not adhesively connected.

The outer diameter 94 of the torsionally stretchable seal 48 is adhesively connected to the surface 40 of the counterbore 38 while the inner diameter 92 is frictionally connected to the lower surface 60 of the body portion 54. The outer diameter 94 can be snug fit utilizing friction or it may utilize adhesive 98, such as Cyanoacrylates like "super glues", "instant adhesives" and the like. The use of adhesives 98 versus snug fits on the outer diameter 94 depends in large part on the type of rubber used as will be described below. Finally, the upper face 90 of the torsionally stretchable seal 48 is connected to the head portion 52 of the pin 42 by a friction or adhesive fit.

FIG. 6 shows a second embodiment of my invention, the sure-seal rolling pin assembly 10 having a protective cap 100. The protective cap 100 is removably connected to a top surface 102 of the head portion 52 of the pin 42 by the insertion of connecting means 104 through the protective cap 100 and into a counterbore 106 of the head portion 52. The protective cap 100 protects the pin 42, concentrically encloses the head portion 52, and is operatively connected to the upper face 90 of the torsionally stretchable seal 48 to allow the torsionally stretchable seal 48 to torsionally stretch when dragged by the rotation of the pin 42. The connecting means 104 can be a slotted round head cap screw or the like. By providing each of the pins 42 with a protective cap 100, the pins 42 are protected during operation with the protective caps 100 readily replaced by loosing the connecting means 104. An additional advantage of using the protective caps 100 is that the pins 42 can be made of less expensive carbon steels. Finally, the structure of the protective caps 100 allows the protective cap 100 to connect and ride atop the torsionally stretchable seal 48 so that abrasives do not get onto the head portion 52 and do not get into the plurality of ball bearing units 46, as might happen if the protective caps 100 extended into the counterbore 38 of the plurality of gears 28.

The action of the torsionally stretchable seal 48 in its relaxed state 80 and when torsionally stretched 86 is shown in FIGS. 7–10. During lapping operation, each pin 42 engages, meshes, and thereafter disengages from the teeth 44 of the work carriers 30 intermittently to drive the work carriers 30 as shown in FIGS. 2 and 4. The work carriers 30 touch and roll over the outer surface 58 of the head portion 52 of the pin 42 thereby reducing adjustments, such as elevational adjustments, that are normally required by the lapping and polishing machine 12. Because the work carriers 30 contact the head portion 52 instead of the outer ring 74 of the plurality of ball bearing units 46, there is more room for wear on the rolling pin structure and less need for fine adjustments as the pins 42 wear out. Consequently, down-time of the machine is reduced and expenses are saved.

The engagement of the pins 42 and the work carriers 30 forces the pins 42 to rotate at small angles, as shown in FIG. 3. This "meshing" process of the pins (i.e. the rotation of the pins 42 during the time of contact with the work carriers 30) and the work carriers 30 occurs without slipping and thus reduces the wear on the pin 42. The pin 42 rotates at an angle 108 having a value measured as $2\alpha$ in FIG. 3. The value is typically between zero and 30 degrees, depending on the gear size and the number of pins 42 used. Because the pin 42 rotates at the angle 108, the inner diameter 92 of the torsionally stretchable seal 48 torsionally stretches the angle 108, typically between zero and 30 degrees, and therefore, the torsionally stretchable seal 48 maintains full contact with the lower surface 60 of the body portion 52 of the pin 42. The outer diameter 94 remains in full stationary contact with the surface 40 of the counterbore 38. The rotational and torsional stretching of the inner diameter 92 is best shown diagrammatically in FIGS. 8 and 10 by means of the lines 82 which are elongated and curved by the rotation of the pin 42 and stretching of the torsionally stretchable seal 48, as shown by the arrows. Note that the lines 82 remain fixed at their contact with the outer diameter 94 while the lines 82 move the angle 108 having the value measured as $2\alpha$ at the inner diameter 92. The rotation of the pin 42 is substantially frictionless and is negligibly affected by the presence of the torsionally stretchable seal 48.

Under the working conditions shown in FIGS. 3 and 7–10, the pin 42 drags and stretches the torsionally stretchable seal 48 during this slight rotation until the next adjacent pin 112 takes over to mesh the next corresponding tooth 44 on the work carrier 30. During this rotation, the pin 42 always maintains a full contact with the torsionally stretchable seal 48. After the pin 42 disengages with the tooth 44 of the work carrier 30, the torsionally stretchable seal 48 quickly restores to its relaxed state 80 due to the torsionally stretchable seal's 48 elasticity. Due to the fact that the pin 42 rotates freely within a certain small angle, there is no sliding action between the pin 42 and the teeth 44 of the work carrier 30. This virtually eliminates wear on both the pins 42 and the teeth 44 of the work carriers 30. This also means that less scratching on the work pieces 32 occurs from particle contamination with the sure-seal rolling pin assembly 10 drives when compared to other planetary pin drives.

Finally, the selection of proper material for the torsionally stretchable seal 48 is crucial to the successful functioning of the sure-seal rolling pin assembly 10 as mentioned above. In addition to having proper chemical resistance, the torsionally stretchable seal 48 must be flexible enough to stretch during the pin's 42 slight rotation. Otherwise, this stretch resistance will overcome the sliding friction between the pins 42 and the teeth 44 of the work carriers 30 causing excessive wear. The bigger the pin rotation angle, the softer the torsionally stretchable seal 48 must be because if harder rubber materials are used, the pin 42 will act like a fixed pin and will wear faster. Since the pins 42 on the sun gear 36, as shown in FIGS. 2 and 3, rotate at a bigger angle than those on the ring gear 34, soft rubber should be used with the pins 42 on the sun gear 36 to accommodate the bigger stretching of the torsionally stretchable seal 48.

The torsionally stretchable seal 48 can be made of many natural and synthetic polymeric rubbers which exhibit excellent flexibility. The flexibility of these soft materials is determined by their durometer numbers. The ideal durometer range for the sure-seal rolling pin assembly 10 is in the range of 20 to 45 shore A. Typical seal materials for my invention include, but are not limited to, natural rubber (i.e. Latex) and synthetic polymeric rubbers, such as Neoprene, Silicon, Buna-N, Butyl, EPDM, Polyurethane, Sorothane, SBR, and Viton.

As various possible embodiments may be made in the above invention for use for different purposes and as various changes might be made in the embodiments and methods above set forth, it is understood that all of the above matters here set forth or shown in the accompanying drawings are to be interpreted as illustrative and not in a limiting sense.

I claim:

1. A sure-seal rolling pin assembly for a lapping and polishing machine for substantially eliminating friction between the sure-seal rolling pin assembly and a work carrier and for substantially reducing particle contamination between the sure-seal rolling pin assembly and the work carrier, the lapping and polishing machine having a plurality of gears operatively connected to one another by the work carrier, each gear having a counterbore, the counterbore having a surface, the sure-seal rolling pin assembly comprising:

a pin having a longitudinal axis, a head portion and a body portion being connected to the head portion, the head portion having a diameter and an outer surface, the body portion having a lower surface being located adjacent the outer surface, the body portion being removably inserted into the counterbore of one of the gears;

a plurality of ball bearing units being axially retained and concentrically connected to the body portion, the plurality of ball bearing units being connected to the surface of the counterbore and allowing the pin to rotate about the longitudinal axis; and a torsionally stretchable seal having a relaxed state and capable of elastic restorability, the torsionally stretchable seal creating a seal between the pin and the surface of the counterbore while in the relaxed state, the torsionally stretchable seal having an upper face, an inner diameter, and an outer diameter being concentrically located around the inner diameter, the inner diameter being connected to the lower surface of the body portion so as to allow the inner diameter to torsionally stretch when dragged by the rotation of the pin about the longitudinal axis, the inner diameter maintaining full contact with the lower surface of the body portion while the pin undergoes rotational movement about the longitudinal axis, the outer diameter being connected to the surface of the counterbore, the outer diameter maintaining full stationary contact with the surface of the counterbore while the pin undergoes rotational movement about the longitudinal axis, the torsionally stretchable seal maintaining a seal between the pin and the surface of the counterbore while the pin undergoes rotational movement about the longitudinal axis, the torsionally stretchable seal maintaining the seal while the pin returns to the relaxed state.

2. The sure-seal rolling pin assembly of claim 1, the lower surface of the pin further comprising a plurality of inner rings, each inner ring having a groove for connecting each ball bearing unit to the body portion, the plurality of inner rings maximizing the diameter of the head portion.

3. The sure-seal rolling pin assembly of claim 2, the plurality of ball bearing units further comprising an upper ball bearing unit and a lower ball bearing unit being axially located opposite the upper ball bearing unit, the upper ball bearing unit and the lower ball bearing unit being concentrically located about the longitudinal axis, each ball bearing unit further comprising a plurality of balls, a crown-shaped retainer operatively connected to the plurality of balls, and an outer ring substantially enclosing the plurality of balls and the crown-shaped retainer, the outer ring having an outer surface and a top surface being located normal and adjacent the outer surface, the plurality of balls riding in one of the inner rings in a substantially frictionless manner, the outer surface of the outer ring being connected to the surface of the counterbore.

4. The sure-seal rolling pin assembly of claim 3, wherein the outer surface of the outer ring of the upper ball bearing unit is adhesively connected to the surface of the counterbore, the outer surface of the outer ring of the lower ball bearing unit being frictionally connected to the surface of the counterbore, the outer diameter of the torsionally stretchable seal being adhesively connected to the surface of the counterbore, the inner diameter being frictionally connected to the lower surface of the body portion and the upper face of the torsionally stretchable seal being connected to the head portion of the pin.

5. The sure-seal rolling pin assembly of claim 1, wherein the pin engages, meshes, and thereafter disengages from the work carrier without slipping, the pin rotating an angle having a value between zero and 30 degrees, the inner diameter of the torsionally stretchable seal torsionally stretching the angle having the value between zero and 30 degrees while maintaining full contact with the lower surface of the body portion, the rotation of the pin being substantially frictionless.

6. The sure-seal rolling pin assembly of claim 1, wherein the pin engages, meshes, and thereafter disengages from the work carrier, the work carrier touching and rolling over the outer surface of the head portion of the pin thereby reducing adjustments required by the lapping and polishing machine.

7. A sure-seal rolling pin assembly for a lapping and polishing machine for substantially eliminating friction between the sure-seal rolling pin assembly and a work carrier and for substantially reducing particle contamination between the sure-seal rolling pin assembly and the work carrier, the lapping and polishing machine having a plurality of gears operatively connected to one another by the work carrier, each gear having a counterbore, the counterbore having a surface, the sure-seal rolling pin assembly comprising:

a pin having a longitudinal axis, a head portion and a body portion being connected to the head portion, the head portion having a counterbore, a diameter, a top surface, and an outer surface, the body portion having a lower surface being located adjacent the outer surface, the body portion being removably inserted into the counterbore of one of the gears;

a plurality of ball bearing units being axially retained and concentrically connected to the body portion, the plurality of ball bearing units being connected to the surface of the counterbore and allowing the pin to rotate about the longitudinal axis;

a torsionally stretchable seal having a relaxed state and capable of elastic restorability, the torsionally stretchable seal creating a seal between the pin and the surface of the counterbore while in the relaxed state, the torsionally stretchable seal having an upper face, an inner diameter, and an outer diameter being concentrically located around the inner diameter, the inner diameter being connected to the lower surface of the body portion so as to allow the inner diameter to torsionally stretch when dragged by the rotation of the pin about the longitudinal axis, the inner diameter maintaining full contact with the lower surface of the body portion while the pin undergoes rotational movement about the longitudinal axis, the outer diameter being connected to the surface of the counterbore, the outer diameter maintaining full stationary contact with the surface of the counterbore while the pin undergoes rotational movement about the longitudinal axis, the torsionally stretchable seal maintaining a seal between the pin and the surface of the counterbore while the pin undergoes rotational movement about the longitudinal axis, the torsionally stretchable seal maintaining the seal while the pin returns to the relaxed state; and a protective cap being removably connected to the top surface of the head portion of the pin by the insertion of connecting means through the protective cap and into the counterbore of the head portion, the protective cap protecting the pin, the protective cap concentrically enclosing the head portion and operatively connected to the upper face of the torsionally stretchable seal to allow the torsionally stretchable seal to torsionally stretch when dragged by the rotation of the pin.

8. A sure-seal rolling pin assembly for substantially reducing particle contamination when operated with a lapping and polishing machine for substantially eliminating friction between the sure-seal rolling pin assembly when operated with a gear driven work carrier with a counterbore gear surface, the improvement comprising:

a pin having a longitudinal axis, the pin being for cooperative engagement with the counterbore gear surface;

a plurality of ball bearing units being axially retained and concentrically connected to the pin, the plurality of ball bearing units for connection to the counterbore gear surface to allow the pin to rotate about said longitudinal axis; and a torsionally stretchable elastomeric seal having a memory characteristic with the seal being movable back and forth relative to an outside surface of the pin from a relaxed sealed state to a stretched sealed state to avoid particle contamination.

* * * * *